US006735410B2

(12) United States Patent
Sekiguchi

(10) Patent No.: US 6,735,410 B2
(45) Date of Patent: May 11, 2004

(54) DEVELOPING DEVICE FEATURING A FIRST DEVELOPER BEARING MEMBER AND A SECOND, SWINGABLE DEVELOPER BEARING MEMBER

(75) Inventor: Hajime Sekiguchi, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 8 days.

(21) Appl. No.: 10/156,181

(22) Filed: May 29, 2002

(65) Prior Publication Data

US 2002/0181974 A1 Dec. 5, 2002

(30) Foreign Application Priority Data

May 30, 2001 (JP) ..... 2001/163154

(51) Int. Cl.[7] ..... G03G 15/08
(52) U.S. Cl. ..... 399/269
(58) Field of Search ..... 399/269, 265, 399/267

(56) References Cited

U.S. PATENT DOCUMENTS 5,669,049 A * 9/1997 Palumbo et al. ..... 399/265

FOREIGN PATENT DOCUMENTS

JP 59-223468 * 12/1984
JP 11-2961 * 1/1999

* cited by examiner

*Primary Examiner*—Quana M. Grainger
(74) *Attorney, Agent, or Firm*—Fitzpatrick, Cella, Harper & Scinto

(57) ABSTRACT

A developing device including: a developing container for containing a developer, the developing container being provided so as to oppose an image bearing member; first and second developer bearing members for bearing and carrying the developer in the developing container to the image bearing member; and a pressurizing member for pressurizing the vicinity of an end of the second developer bearing member toward the image bearing member side, in which the developing container has a first supporting portion for rotatably supporting the vicinity of an end of the first developer bearing member and a second supporting portion for supporting the vicinity of the end of the second developer bearing member rotatably and swingably with the first supporting portion as a swinging center such that a distance between the first developer bearing member and the second developer bearing member does not substantially vary.

7 Claims, 13 Drawing Sheets

DEVELOPING DEVICE FEATURING A FIRST DEVELOPER BEARING MEMBER AND A SECOND, SWINGABLE DEVELOPER BEARING MEMBER

BACKGROUND OF THE INVENTION

1. Field of the Invention

The present invention relates to a developing device of an image forming apparatus for forming an image using the electrophotographic system and, more specifically, to a developing device of an image forming apparatus such as a copying machine, a printer and a facsimile machine.

2. Description of Related Art

Conventionally, for example, in an image forming apparatus such as a copying machine and a laser beam printer using the electrophotographic system, an electrostatic latent image is formed on a surface of an electrophotographic photosensitive member (photosensitive drum), for example, of a cylindrical shape functioning as an image bearing member, the electrostatic latent image is developed by a developing device and the developed image is transferred to a recording material and then fixed thereon by a fixing device to form an image on the recording material.

FIG. 12 shows a schematic structure of a copying machine as an example of a conventional image forming apparatus of the electrophotographic system. In such an image forming apparatus, an image of an original is read by an image reading portion 8, exposure is applied to a surface of a photosensitive drum 1 functioning as an image bearing member from an image writing portion 9 according to an instruction from a controller (not shown) based on data of the read image to form an electrostatic latent image on the photosensitive drum 1. The surface of the photosensitive drum 1 is uniformly charged at a predetermined potential by a charging device 2 before the exposure by the image writing portion 9. Then, a laser beam or the like is irradiated from the image writing portion 9 onto the uniformly charged photosensitive drum 1, whereby an electrostatic latent image is formed on the photosensitive drum 1.

The electrostatic latent image formed on the photosensitive drum 1 is developed as a so-called toner image by a developing device 3 using developer. Thereafter, the developed toner image is carried to a portion opposed to a transfer device 4 (transfer portion) by the rotation of the photosensitive drum 1.

A recording material P such as a recording sheet is fed one by one from a recording material containing cassette 12 by a pickup roller 13 in response to the carrying of the toner image on the photosensitive drum 1 and, at the same time, is transported to a part where the photosensitive drum 1 and the transfer device 4 oppose each other while timing being taken by a registration roller pair 14. Then, when the recording material P passes the part where the photosensitive drum 1 and the transfer device 4 oppose each other, the toner image on the photosensitive drum 1 is transferred onto the recording material P by an action of the transfer device 4.

The recording material P having the toner image transferred thereon is transported to a fixing device 7 by a predetermined transport device 6. The fixing device 7 is provided with a fixing roller pair consisting of a fixing roller 7*a* and a pressure roller 7*c*. The recording material P is pressurized by the fixing roller pair 7 and, at the same time, heated by a heater 7*b* provided in the fixing roller 7*a*. Thus, unfixed toner on the recording material P is fused and fixed on the recording material P.

Thereafter, the recording material P having the toner image fixed thereon is delivered to a tray 15 provided outside an apparatus main body by a transport roller pair 10, a delivery roller pair 11 and so on.

On the other hand, the surface of the photosensitive drum 1 after the toner image is transferred to the recording material P is subject to removal of transfer residual toner or the like by a cleaner 5 and serves image formation repeatedly. Thus, a series of image forming processes is completed.

An electrostatic latent image such as the one described above that is formed on, for example, the photosensitive drum 1 functioning as an image bearing member by a well-known electrostatic latent image technique is developed by the developing device 3. The developing device 3 is generally provided with a rotatable cylindrical developing sleeve 31 functioning as a developer bearing member in a position opposed to the photosensitive drum 1. That is, the developing device 3 is provided with a developing container 32 for containing developer and defining a developing device main body. A position of the developing container 32 opposed to the photosensitive drum 1 opens along a longitudinal direction of the photosensitive drum 1 (a direction perpendicular to a transport direction of the recording material P). The developing sleeve 31 is positioned in the opening portion and supported rotatably with respect to the developer container 32. The developer in the developing device 3 forms a thin layer of a uniform thickness to be borne on the surface of the developing sleeve 31 and is fed to a developing area where the photosensitive drum 1 and the developing sleeve 31 oppose each other by the rotation of the developing sleeve 31. Then, in the developing area, the toner on the developing sleeve 31 moves to the surface of the photosensitive drum 1, whereby an electrostatic latent image is developed.

FIG. 13 shows a schematic sectional view of an example of a conventional developing device. As illustrated, the photosensitive drum 1 and the developing sleeve 31 are arranged while maintaining a microscopic gap (hereinafter referred to as "SD gap") between them constant. Thus, predetermined development can be performed.

The developer is fed to the developing sleeve 31 by developer agitating and feeding members (agitating members) 37 and 38 provided inside the developing container 32.

FIG. 14 shows an arrangement of the developing sleeve 31 in its axial direction (longitudinal direction). As illustrated, the SD gap can be guaranteed by providing two spacer rollers (abutting rollers) 20, whose outer circumferences abut against the outer circumference of the photosensitive drum 1, functioning as spacer members at both end portions in the longitudinal direction of the developing sleeve 31. The two spacer rollers 20 provided in both ends of the developing sleeve 31 are substantially circular in their cross sections and are arranged such that their rotational centers are concentric with the rotational center of the developing sleeve 31. An outer diameter of the spacer rollers 20 is formed larger than an external diameter of the developing sleeve 31 by a size of the SD gap. In addition, the developing container 32 is pressurized by pressurizing means such as pressurizing springs 51, whereby the spacer rollers 20 are always brought into contact with the outer circumference of the photosensitive drum 1. According to such a structure, the photosensitive drum 1 and the developing sleeve 31 are arranged while keeping the predetermined SD gap.

In general, the spacer rollers 20 are provided with ball bearings (hereinafter referred to simply as "bearings") 20*a* inside the spacer rollers 20. Thus, the outer circumferences of the spacer rollers 20 rotate following the rotation of the photosensitive drum 1, and the inner circumferences of the bearings 20*a* provided inside the spacer rollers 20 is rotated by the rotation of the developing sleeve 31.

Parts of the spacer rollers 20 abutting against the photosensitive drum 1 are formed of a material that is excellent in slidability, hard to be worn and unlikely to scratch the photosensitive drum 1. In general, a POM-based resin or an ultrahigh molecular weight polyethylene resin is used as the material.

As shown in FIG. 14, the developing sleeve 31 is supported at its both ends rotatably with respect to the developing container 32 of the developing device 3 via the bearings 21. In the illustrated example, the developing sleeve 31 is supported with respect to the developing container 32 on the inner side inside positions in which the spacer rollers 20 are provided on the rotary shafts (both end shaft portions) 31*a* provided at both the ends of the developing sleeve 31.

Moreover, a driving gear 23 to which a driving force is transmitted from driving force transmitting means (not shown) is provided on one end side of the developing sleeve 31. A rotational driving force is given to the developing sleeve 31 by the driving gear 23.

The developing device having the one developing sleeve 31 as described above generally increases a peripheral speed of the developing sleeve 31 to rotate at approximately 150 to 200% of a peripheral speed of the photosensitive drum 1 to perform development.

In order to cope with the increased process speed of image formation (copy speed-up), it is necessary to further increase the peripheral speed of the developing sleeve 31. If the peripheral speed of the developing sleeve 31 is insufficient, a developer is in short supply and an image density decreases.

However, the developing device 3 including the one developing sleeve 31 has the following problems for coping with the speed-up.

That is, fusion bond of a developer due to temperature rising of the developing sleeve 31 occurs by the increased peripheral speed of the developing sleeve 31. Thus, it is likely that a rotational torque of the developing sleeve 31 increases and, moreover, the rotation of the developing sleeve 31 is hindered. In addition, since friction of the developer increases, deterioration of the developer occurs, which is likely to result in image defects.

The inventor of the present invention earnestly repeated examinations in order to solve the above-described problems and, as a result, found that the above-described problems can be solved by providing a plurality of developing sleeves in a developing device to have a multi-stage developing device.

On the other hand, as a result of the examinations by the inventor of the present invention, it was found that the following problems are likely to occur in the multi-stage developing device.

That is, in a developing device with a structure provided with two or more developing sleeves, spacer rollers for guaranteeing an SD gap abut against a surface of a photosensitive drum at four or more parts. However, in such a structure with four spacer rollers, it is likely that the spacer rollers first abut against the surface of the photosensitive drum at three parts and the remaining one spacer roller does not abut against the surface of the photosensitive drum but floats.

It is possible to increase a pressurizing force to the photosensitive drum of the developing container such that the spacer rollers abut against the photosensitive drum at four parts. However, the developing container is deformed by increasing the pressurizing force in this way and, when the spacer rollers are caused to abut against the photosensitive drum in a strained state (a state in which stress is applied to it), vibration that causes image deterioration occurs by the stress applied to the developing container. Moreover, it is likely that such a strained state results in breakage of the developing container.

SUMMARY OF THE INVENTION

The present invention has been devised in view of the above-mentioned drawbacks, and it is an object of the present invention to provide a developing device that is capable of realizing speed-up of image formation and, at the same time, realizing its miniaturization by performing development using a first developer bearing member and a second developer bearing member.

It is another object of the present invention to provide a developing device that is capable of guaranteeing a distance between an image bearing member and the second developer bearing member while guaranteeing a distance between the first developer bearing member and the second developer bearing member.

Further objects of the present invention will be apparent by reading the following detailed description with reference to the attached drawings.

DESCRIPTION OF THE PREFERRED EMBODIMENTS

A developing device and an image forming apparatus in accordance with the present invention will be hereinafter described in detail with reference to the accompanying drawings.

First Embodiment

First, an entire structure and operations of an image forming apparatus of this embodiment will be described with reference to FIGS. 1 and 2. In this embodiment, the image forming apparatus is assumed to be a copying machine using the electrophotographic system and forms an image corresponding to information of an original on a recording material such as a recording sheet and an OHP sheet.

Figure 1:
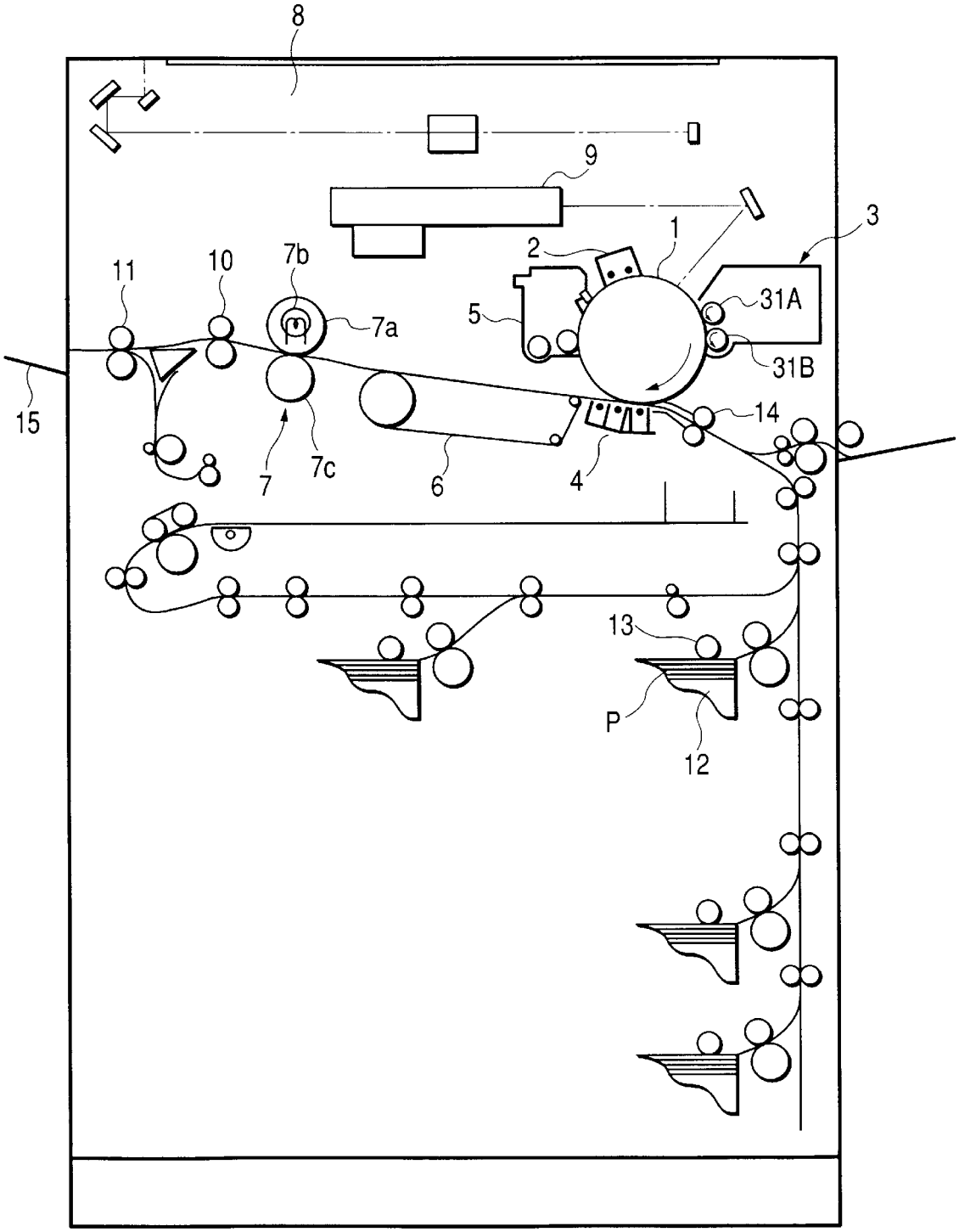
FIG. 1 is a schematic longitudinal sectional view of an embodiment of an image forming apparatus in accordance with the present invention.
Figure 12:
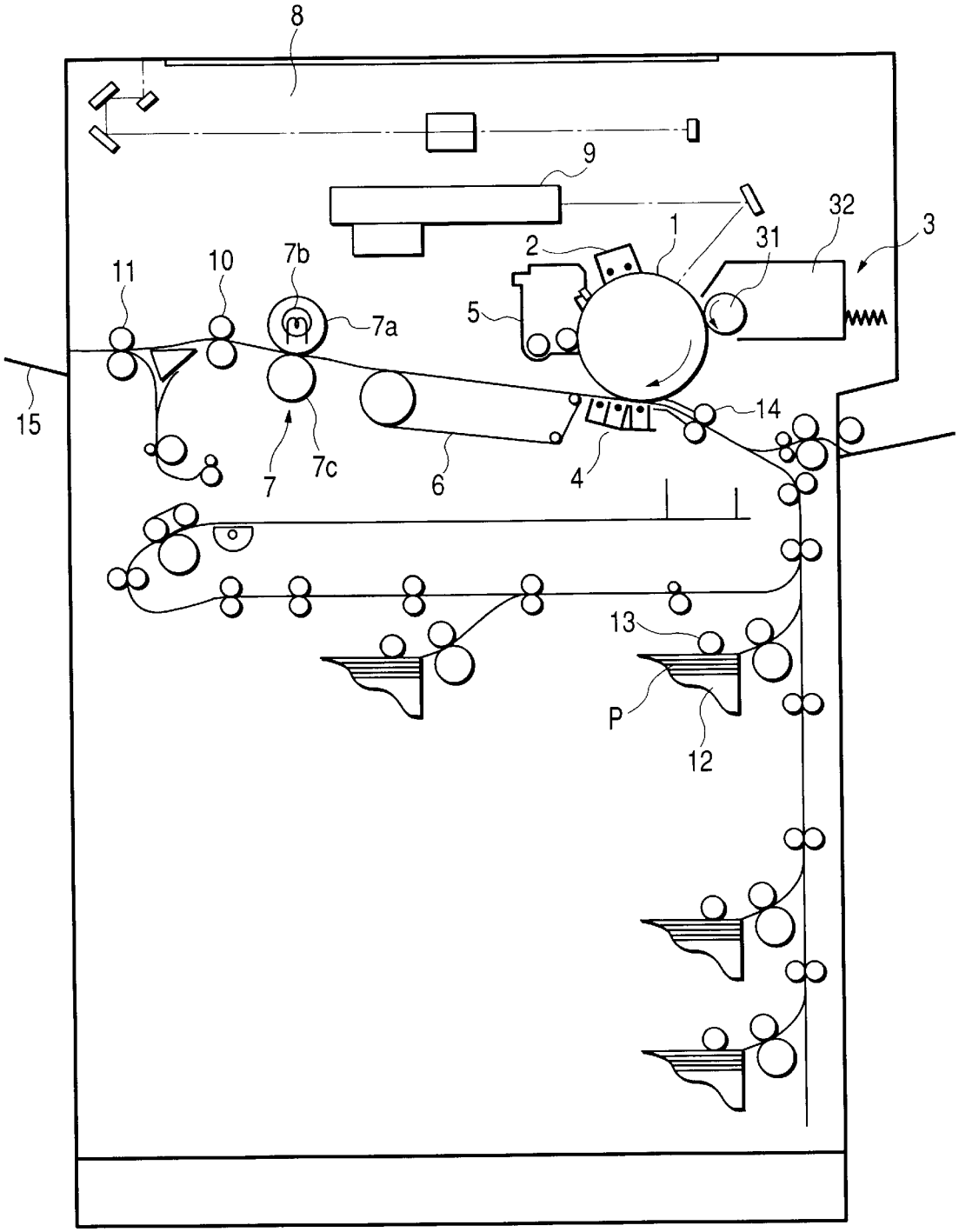
FIG. 12 is a schematic longitudinal sectional view of an example of a conventional image forming apparatus.
Figure 13:
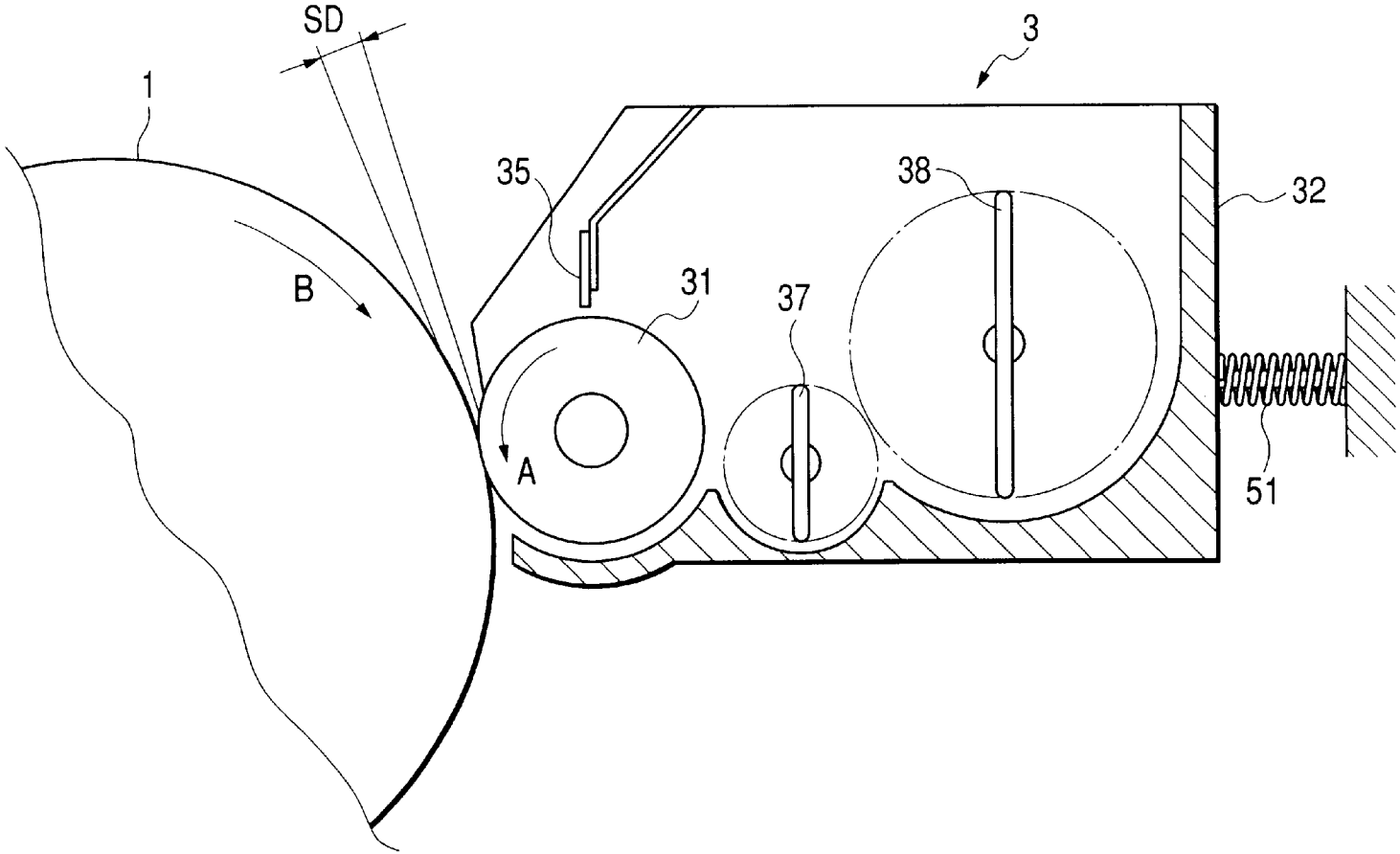
FIG. 13 a schematic longitudinal sectional view of an example of a conventional developing device.
Figure 14:
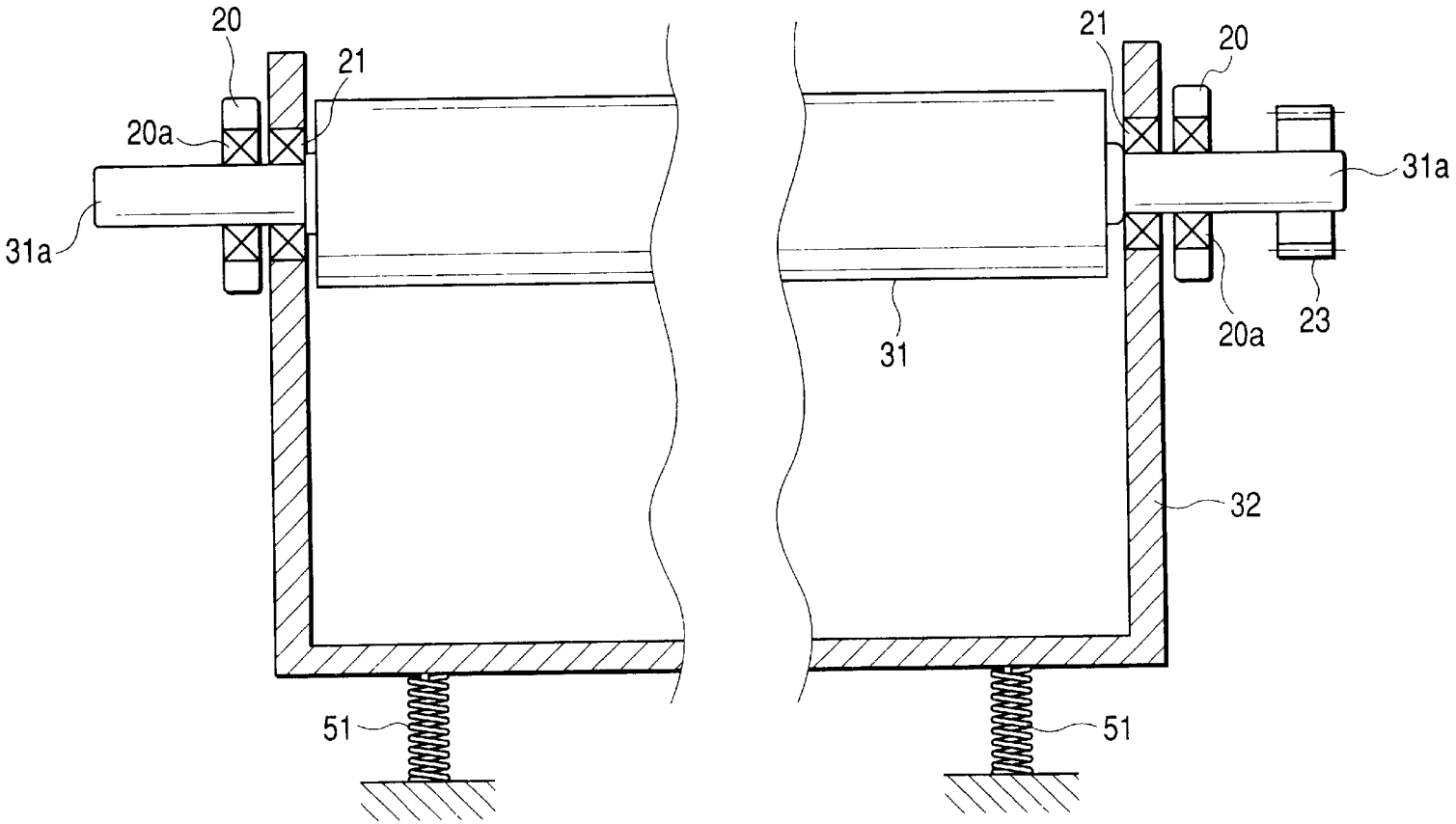
FIG. 14 is a schematic transverse sectional view for illustrating a structure in the longitudinal direction of the developing device of FIG. 13.

FIG. 1 shows a schematic cross section of the image forming apparatus of this embodiment. In addition, FIG. 2 shows a schematic cross section of a developing device 3. Further, in the image forming apparatus of this embodiment, elements having the same functions and structures as the conventional image forming apparatus that is described with reference to FIG. 12 are denoted by the identical reference symbols.

In the image forming apparatus of this embodiment, an image of an original is read by the image reading portion 8, exposure is applied to the surface of a cylindrical electrophotographic photosensitive member functioning as an image bearing member, that is, the photosensitive drum 1, from the image writing portion 9 according to an instruction from a controller (not shown) based on data of the read image to form an electrostatic latent image on the photosensitive drum 1. The surface of the photosensitive drum 1 is uniformly charged at a predetermined potential by the charging device 2 before the exposure by the image writing portion 9. Then, a laser beam or the like is irradiated on the uniformly charged photosensitive drum 1 from the image writing portion 9, whereby an electrostatic latent image is formed on the photosensitive drum 1. The electrostatic latent image formed on the photosensitive drum 1 is developed as a so-called toner image by the developing device 3 using a developer.

Figure 2:
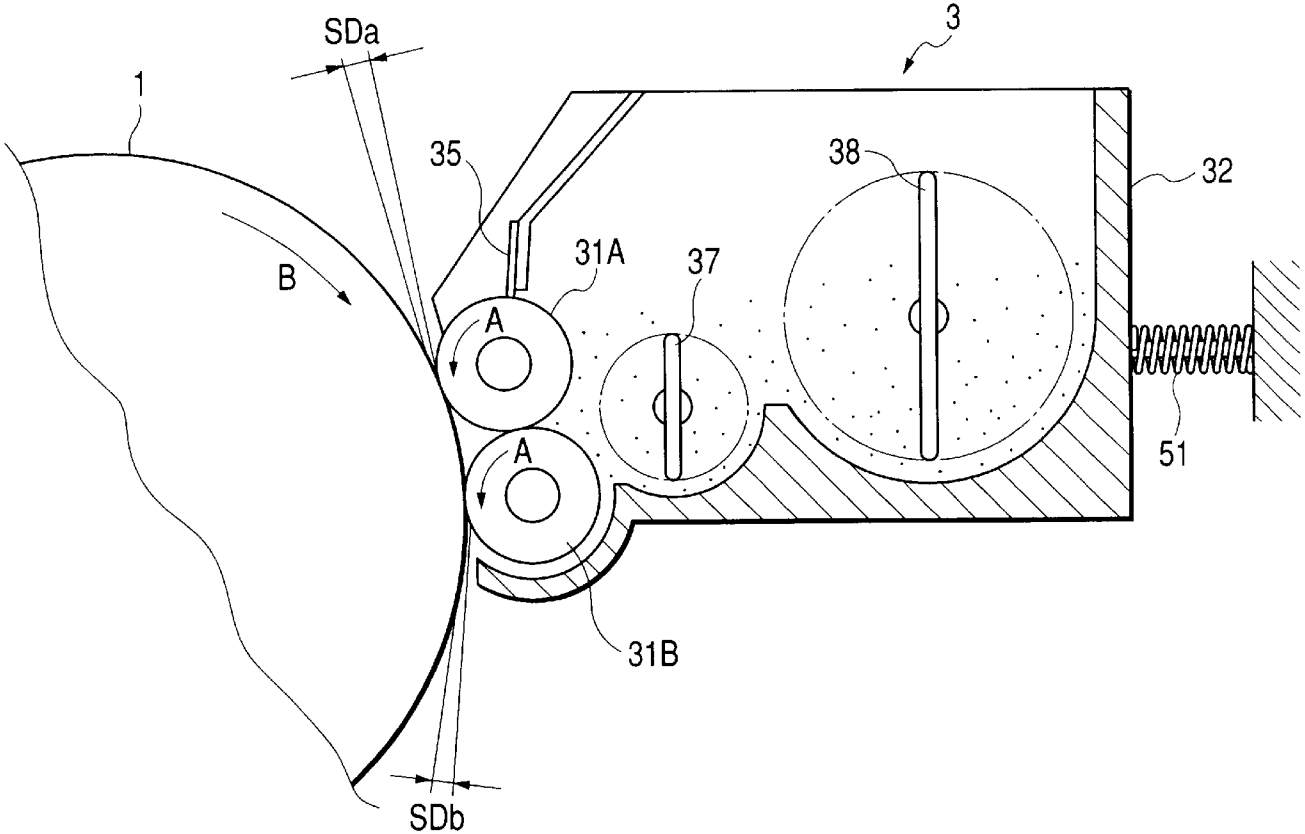
FIG. 2 is a schematic longitudinal sectional view of an embodiment of a developing device in accordance with the present invention.

As shown in FIG. 2 more in detail, in this embodiment, the developing device 3 is provided with cylindrical first and second developing sleeves 31A and 31B, which are rotatable respectively, as first and second developer bearing members in positions opposing the photosensitive drum 1. On surfaces of the first and second developing sleeves 31A and 31B, the developer in the developing device 3 forms a thin layer of a uniform thickness to be borne thereon as discussed in detail below.

The first and second developing sleeves 31A and 31B rotate in the same direction, i.e., in a direction indicated by the arrows A in FIG. 2, and feed the developer to developing areas where the photosensitive drum 1 and each of the developing sleeves 31A and 31B oppose each other. On the other hand, the photosensitive drum 1 rotates in a direction indicated by the arrow B in FIG. 2 and the electrostatic latent image on the photosensitive drum 1 is carried to the developing areas where the photosensitive drum 1 opposes each of the developing sleeves 31A and 31B.

The electrostatic latent image formed on the photosensitive drum 1 is first developed in the developing area of the first developing sleeve 31A of the developing device 3 that is positioned most upstream of development processes by a plurality of developer bearing members. Next, the electrostatic latent image is developed in the developing area of the second developing sleeve 31B. The development process in each developing area is a development process of an electrostatic latent image by a well-known electrostatic latent image technique.

In this embodiment, magnetic mono-component toner (toner) is used as a developer. For example, a stationary magnet roll (not shown) is provided as magnetic field generating means in each of the developing sleeves 31A and 31B. The developer (toner) in the developing container 32 is supplied to each of the developing sleeves 31A and 31B by a magnetic field of this magnetic field generating means. Then, as described in detail below, the toner borne as a thin layer of a predetermined layer thickness on each of the developing sleeves 31A and 31B moves to a part where negative charges of the uniformly charged photosensitive drum 1 are decayed by exposure and performs reversal development. Usually, for example, a developing bias in which an AC voltage is superimposed on a DC voltage is applied to each of the developing sleeves 31A and 31B at the time of development.

Further, the present invention relates to a structure for positioning a developer bearing member and does not limit a developing system to the one described in the above embodiment. A well-known developing system can be appropriately employed for each developing area (each developer bearing member). For example, a two-component developer containing a magnetic carrier and nonmagnetic toner can be used as a developer. Such a two-component developer can stand like the ears of rice (magnetic brush) on a developer bearing member incorporating magnetic field generating means. An electrostatic latent image formed on an image bearing member can be developed by causing this magnetic brush to contact the image bearing member or to oppose the image bearing member in a non-contact state.

The development is performed twice with respect to a common electrostatic latent image formed on a photosensitive body in this way, whereby a developing area can be provided wider compared with the development by one developing sleeve.

Consequently, an adverse effect by the increased process speed of image formation (copy speed-up) as described above can be eliminated. That is, the above-described problems that, in order to cope with increased process speed with one developing sleeve, temperature of a developing sleeve rises and fused bond of a developer occurs due to increase in a peripheral speed of the developing sleeve, whereby a rotational torque of the developing sleeve increases and, moreover, rotation of the developing sleeve is hindered do not occur. In addition, the problems that deterioration of the developer occurs because friction of the developer increases, which causes image defects, can be prevented.

In addition, most development is performed by the first developing sleeve 31A and finishing development is performed by the second developing sleeve 31B with respect to the above-described electrostatic latent image. Therefore, in this embodiment, the first developing sleeve 31A is supported rotatably with respect to the developing container and the second developing sleeve 31B is supported rotatably with respect to the developing container and swingably supported with the first developing sleeve 31A as a swinging center.

SDa and SDb, which are microscopic gaps (SD gaps), are maintained constant between the photosensitive drum 1 and the first developing sleeve 31A and between the photosensitive drum 1 and the second developing sleeve 31B, respectively. Consequently, predetermined development can be performed.

Thereafter, the developed toner image is carried to a portion opposed to a transfer device 4 (transfer portion) by the rotation of the photosensitive drum 1.

A recording material P such as a recording sheet is forwarded one by one from a recording material containing cassette 12 by a pickup roller 13 in response to the carrying of the toner image on the photosensitive drum 1 and, at the same time, is transported to a part where the photosensitive drum 1 and the transfer device 4 oppose each other while timing being taken by a registration roller pair 14. Then, when the recording material P passes the part where the photosensitive drum 1 and the transfer device 4 oppose each other, the developed toner image on the photosensitive drum 1 is transferred onto the recording material P by an action of the transfer device 4.

The recording material P having the toner image transferred thereon is transported to a fixing device 7 by a predetermined transport device 6. The fixing device 7 is provided with a fixing roller pair consisting of a fixing roller 7*a* and a pressure roller 7*c*. The recording material P is pressurized by the fixing roller pair 7 and, at the same time, heated by a heater 7*b* provided in the fixing roller 7*a*. Thus, unfixed toner on the recording material P is fused and fixed on the recording material P.

Thereafter, the recording material P having the toner image fixed thereon is delivered to a tray 15 provided outside an apparatus main body by a transport roller pair 10, a delivery roller pair 11 and the like.

On the other hand, the surface of the photosensitive drum 1 after the toner image is transferred to the recording material P is subject to removal of transfer residual toner or the like by a cleaner 5 and served for image formation repeatedly. Thus, a series of image forming processes end.

Figure 3:
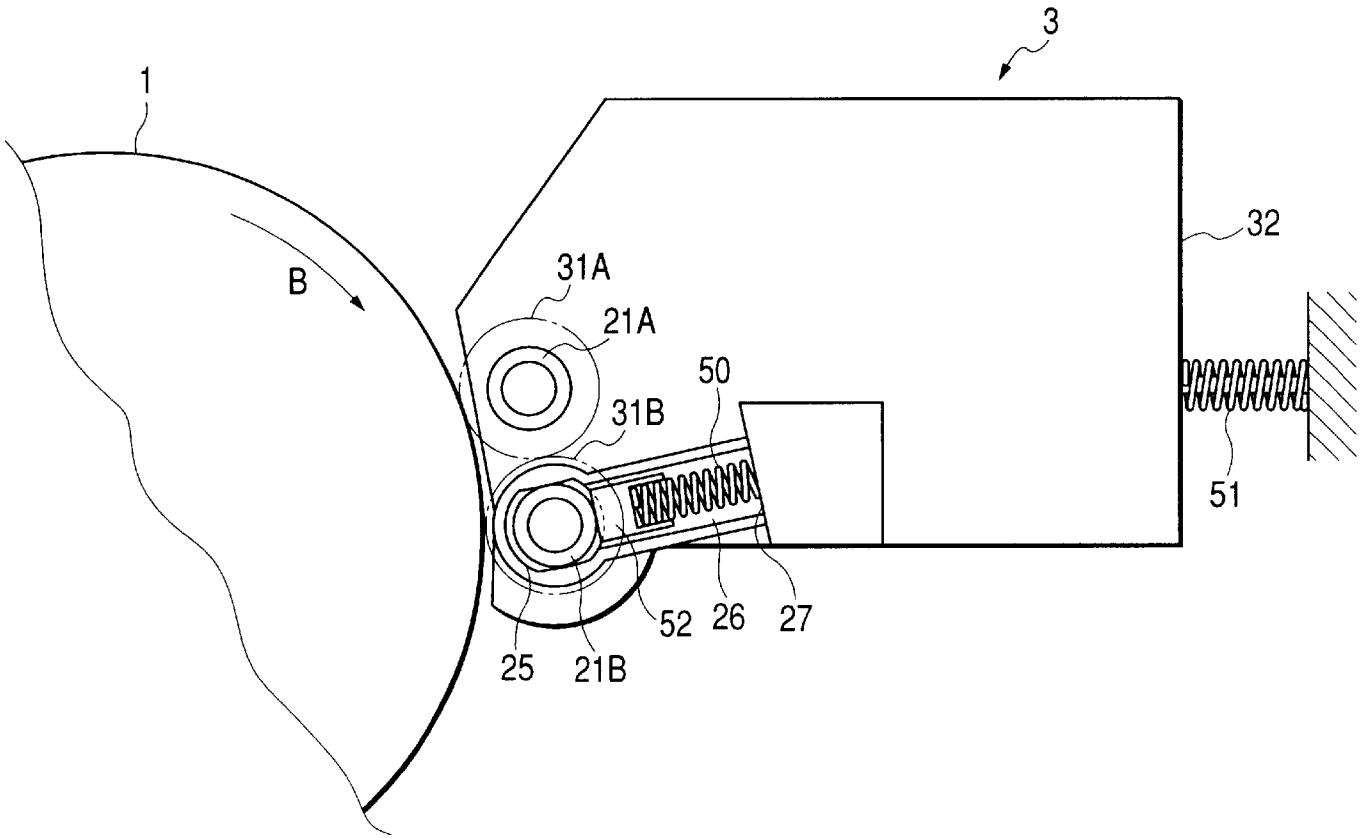
FIG. 3 is a schematic side view of the developing device of FIG. 2.
Figure 4:
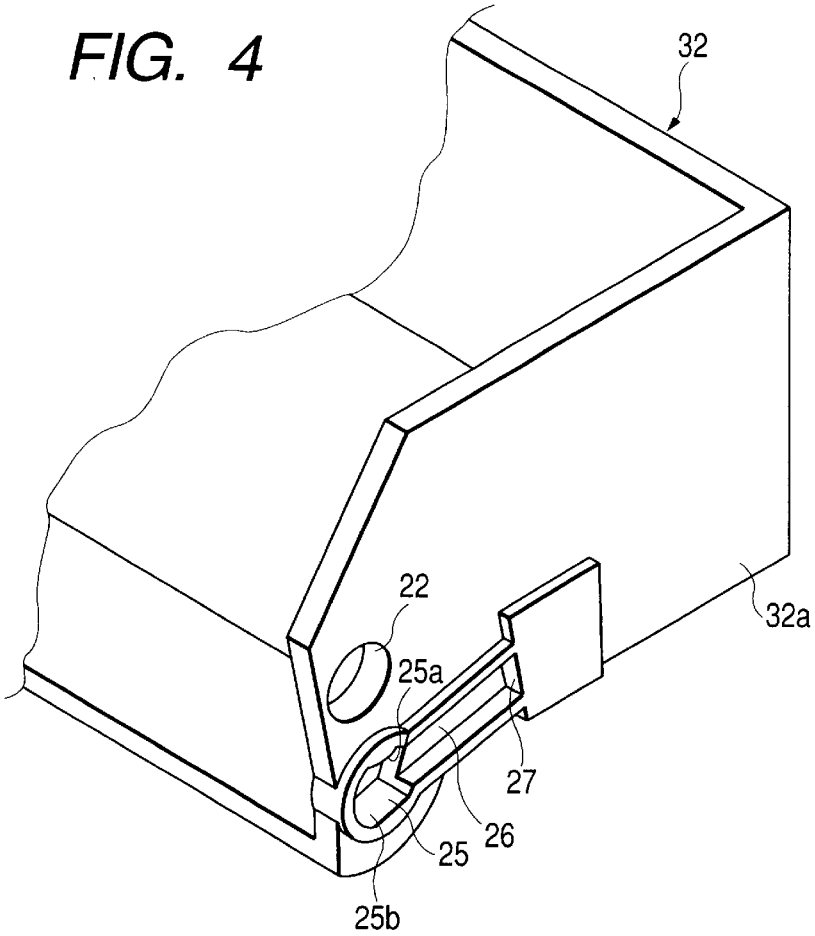
FIG. 4 is a partial perspective view of a developing container showing the vicinity of a supporting member of a developer bearing member in the developing device of FIG. 2.
Figure 5:
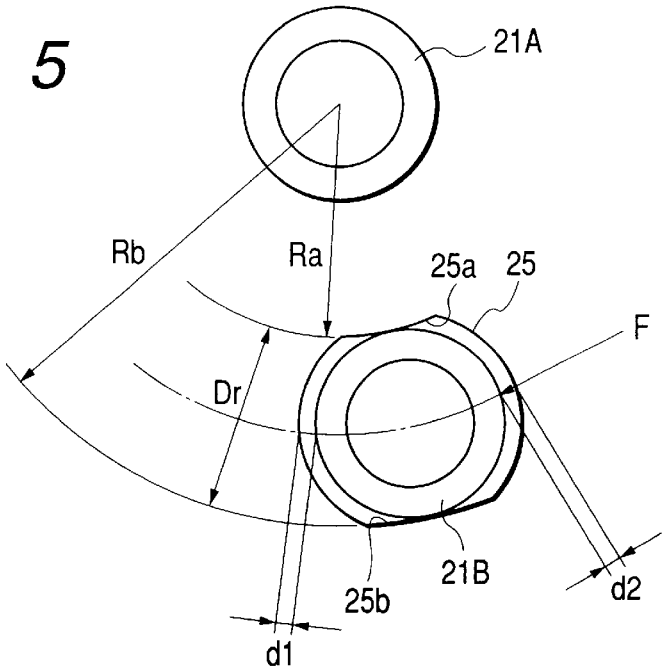
FIG. 5 is a schematic structural view showing the vicinity of a supporting portion of each developer bearing member for illustrating a positional relationship of first and second developer bearing members and a pressurized form of the second developer bearing member.
Figure 6:
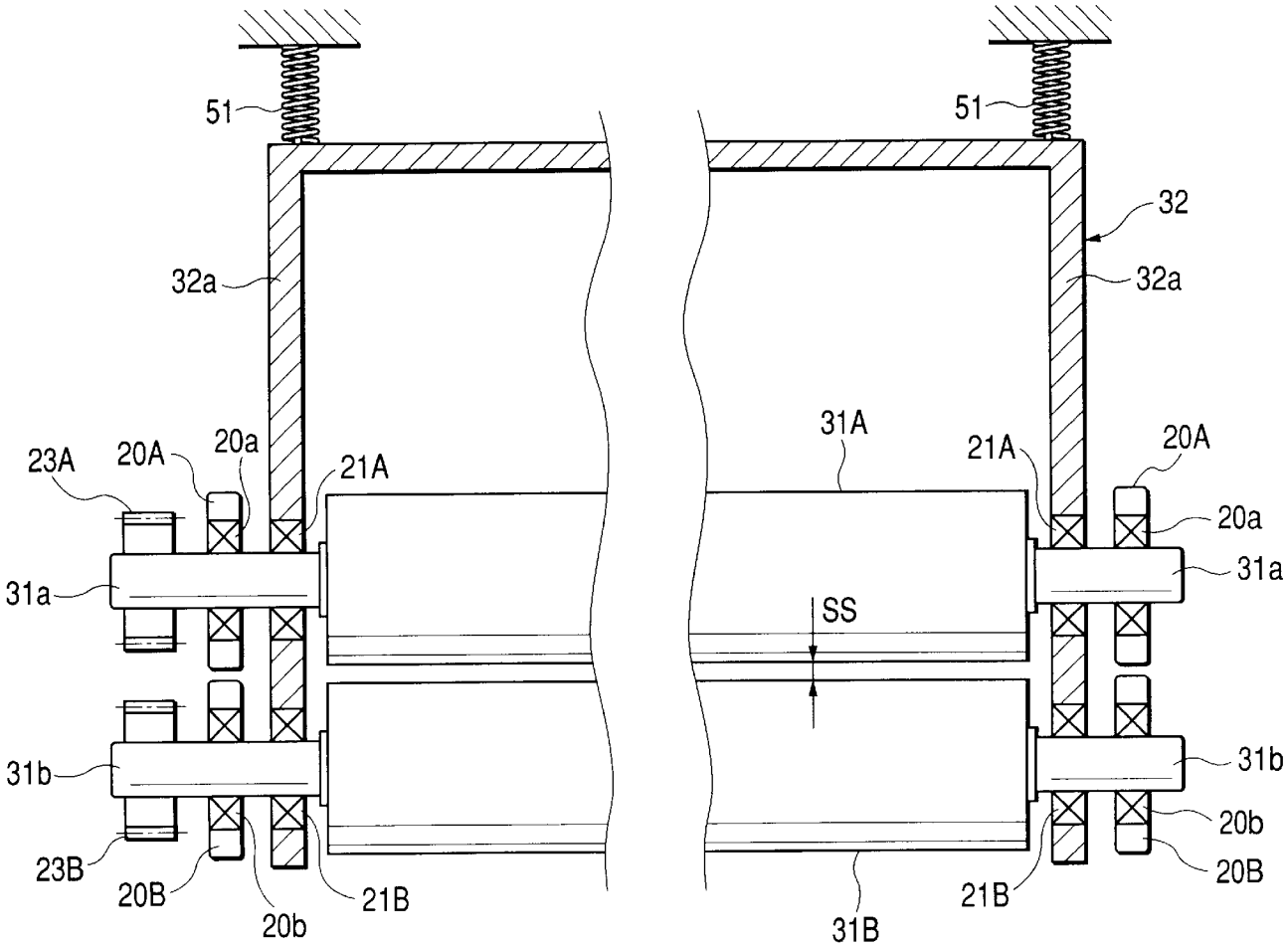
FIG. 6 is a schematic transverse sectional view of the developing device of FIG. 2 for illustrating a structure in the longitudinal direction of the developing device.

Next, the arrangement of the first and second developing sleeves 31A and 31B will be further described with reference to FIGS. 3 to 6. FIG. 3 shows a side of the developing device 3 of this embodiment and FIG. 4 shows the vicinity of one side in a longitudinal direction of the developing container 32 of the developing device 3 in an enlarged form. In addition, FIG. 5 shows a positional relationship between the first developing sleeve 31A and the second developing sleeve 31B and a pressurizing force applied to the second developing sleeve 31B and FIG. 6 shows a structure in a longitudinal direction of the developing device 3.

First, a supporting structure of the first developing sleeve 31A will be described. In this embodiment, the first developing sleeve 31A as a first developer bearing member is supported rotatably with respect to the developing container 32 via bearings 21A as supporting members in rotary shafts (both end shaft portions) 31*a* extending to both the end portions in a rotational axis direction (longitudinal direction) of the first developing sleeve 31A. The bearings 21A are attached to attaching hole portions 22 as first supporting portions provided on both sidewalls 32*a* of the developing container 32, respectively. Consequently, the first developing sleeve 31A is structured to be rotatable but unable to move in a direction in which it abuts against or spaces apart from the photosensitive drum 1 or in a direction in which it approaches or separates from the second developing sleeve.

In addition, the developing container 32 is energized toward the photosensitive drum 1 by first pressurizing means functioning as a developer container pressurizing member, that is, the pressurizing springs (coil springs) 51 functioning as elastic members. In this embodiment, as shown in FIG. 6, the pressurizing springs 51 are pressurized toward the photosensitive drum 1 in two parts in the vicinity of both end portions in the longitudinal direction of the developer container 32.

The predetermined gap (SD gap) SDa (FIG. 2) between the first developing sleeve 31A and the photosensitive drum 1 is guaranteed by the spacer rollers 20A, which are provided in the both end shaft portions 31*a* of the first developing sleeve 31A, abutting on the photosensitive drum 1 as a spaced members. In this embodiment, the spacer rollers 20A are provided on more outer side than supporting portions of the both end shaft portions 31*a*. An external diameter of the spacer rollers 20A is set larger than an external diameter of the first developing sleeve 31A by a size of SDa that is the SD gap for the first developing sleeve 31A. The structure of the spacer rollers 20A is the same as that of the spacer rollers described as the conventional example.

Consequently, the developing container 32 is pressurized toward the photosensitive drum 1 by the pressurizing springs 51, whereby the spacer rollers 20A abut against the photosensitive drum 1 and the gap (SD gap) between the first developing sleeve 31A and the photosensitive drum 1 is guaranteed. In this embodiment, a structure for guaranteeing the SD gap by the spacer rollers 20A for the first developing sleeve 31A is the same as that in the case in which one developing sleeve 31 described as the conventional example is used.

Next, a structure of the second developing sleeve 31B will be described. In this embodiment, the second developing sleeve 31B functioning as a second developer bearing member is supported rotatably with respect to the developer container 32 via bearings 21B functioning as supporting members in rotary shafts (both end shaft portions) 31*b* extending to both end portions in a rotational axis direction (longitudinal direction) of the second developing sleeve 21B. As shown in FIGS. 3 and 4, the bearings 21B of the second developing sleeve 31B are attached in regulating guide groove portions 25 functioning as second supporting portions provided on both sidewalls 32*a* (only one sidewall portion is shown) of the developer container 32, respectively.

As described in detail below, in this embodiment, the bearings 21B of the second developing sleeve 31B are attached in the regulating guide groove portions 25. Therefore, the second developing sleeve 31B is allowed to move only in a rotating direction (direction in which it abuts against and spaces apart from the photosensitive drum 1) within a microscopic area with the first developing sleeve 31A (hole portions 22) as a rotational center while the second developing sleeve 31B is rotating in such time as a development operation. In addition, a predetermined gap is maintained between the first developing sleeve 31A and the second developing sleeve 31B.

As shown in FIG. 5, the regulating guide groove portion 25 includes wall portions 25*a* and 25*b* along a radius Ra and a radius Rb, respectively, which have the rotational center of the developing sleeve 31A as a center. The regulating guide groove portion 25 is formed in a shape for regulating a predetermined gap between the first developing sleeve 31A and the second developing sleeve 31B (hereinafter referred to as "SS gap") by the wall portions 25*a* and 25*b* to guide the second developing sleeve 31B to move with the first developing sleeve 31A as a rotational center.

The bearing 21B of the second developing sleeve 31B is movably fit in an area of a width (gap) Dr between the radius Ra and the radius Rb having the rotational center of the first developing sleeve 31A as a center. Consequently, the bearing 21B is movable in a rotating direction with the rotational center of the first developing sleeve 31A as the center while being regulated by the wall portions 25*a* and 25*b* in a general fitting relationship. For example, a fitting relationship (tolerance relationship) of a bearing external diameter of ø16 generally uses a bearing external diameter ø16g9 (tolerance range of −49 to −6 μm) and a Dr width 16H9 (tolerance range of 0 to 49 μm) (g9 and H9 indicate a shaft diameter and a hole diameter).

More specifically, as shown in FIG. 5, microscopic gaps d1 and d2 are provided on a front end side and a rear end side in the rotational direction with the first developing sleeve 31A as a center, respectively, in the regulating guide groove portion 25 in the state in which the bearing 21B of the second developing sleeve 31B is fit therein. Consequently, the second developing sleeve 31B is allowed to move only in a rotating direction with the rotational center of the first developing sleeve 31A as the center by sizes of the gaps d1 and d2 while being regulated by the wall portions 25*a* and 25*b* along the arcs of the above-described radiuses Ra and Rb of the regulating guide groove portions.

The gaps d1 and d2 are for causing a plurality of developer bearing members (in this embodiment, the first and second developing sleeves 31A and 31B) to approach the photosensitive drum 1 smoothly, that is, for causing the spacer rollers to abut against them. Sizes of the gaps d1 and d2 can be appropriately selected.

That is, since the gap d2 is a gap in a direction in which the second developing sleeve 31B separates from the photosensitive drum 1, it is sufficient to select its dimension taking into account an influence due to rotational unevenness of the photosensitive drum 1. Further, the second development sleeve is swingably energized because it is intended to always maintain a distance between the second developing sleeve 31B and the photosensitive drum 1 to prevent development defects by energizing the spacer rollers provided in the second developing sleeve 31B to always abut against the surface of the photosensitive drum 1 even if the photosensitive drum 1 is decentered and the position of the surface of the photosensitive drum changes.

On the other hand, the gap d1 is a gap in a direction in which the second developing sleeve 31B separates from the developing container 32, that is, a direction in which the second developing sleeve 31B approaches the photosensitive drum 1. It may appropriately select its size in a range up to a maximum dimension in the state in which a developer does not leak by the second developing sleeve 31B separating from the developing container 32.

Next, pressurization to the photosensitive drum 1 of the second developing sleeve 31B will be described. In this embodiment, second pressurizing means, which always pressurizes the second developing sleeve 31B in a direction in which it moves to the photosensitive drum 1, pressurizes the bearing 21B of the second developing sleeve 31B.

In this embodiment, the second pressurizing means is constituted by the pressurizing spring (coil spring) 50 that is an elastic member functioning as a pressurizing member, a pressurizing spring holder (bearing pressurization assisting member) 52 functioning as a pressurizing member receiving member and a pressurizing spring holder groove portion 26 functioning as a pressurizing member containing portion for containing the pressurizing spring 50 and the pressurizing spring holder 52. The pressurizing spring holder groove portion 26 is provided with a pressurizing spring bumping wall portion 27, which is a wall portion that the pressurizing spring 50 abuts against, at its end as a pressurizing member receiving member.

A pressurizing force F as shown in FIG. 5 acts by this pressurizing means, whereby the bearing 21B of the second developing sleeve 31B is moved in a direction toward the photosensitive drum 1 while being regulated in the regulating guide groove portion 25 and always approaches the photosensitive drum 1, that is, a spaced member discussed below abuts against the photosensitive drum 1.

In addition, since the above-described gap d2 is provided in the regulating guide groove portion 25, the second developing sleeve 31B can always be steadily pressurized toward the photosensitive drum 1 even if the second developing sleeve 31B is influenced by rotational unevenness of the photosensitive drum 1 to receive a force in a direction in which it separates from the photosensitive drum 1. The above-described pressurizing means is provided on the other side of the developing container 32 that does not appear on FIGS. 3 and 4, and its structure is assumed to the same with respect to both the ends of the second developing sleeve 31B.

In this embodiment, a gap between the second developing sleeve 31A and the photosensitive drum 1 (SD gap) SDb is guaranteed by spacer rollers 20B functioning as a spaced member provided in the both end shaft portions 31*b* of the second developing sleeve 31B as in the first developing sleeve 31A. In this embodiment, the spacer rollers 20B are provided more outer side than supporting portions of the both end shaft portions 31*b*. The second developing sleeve 31B is pressurized toward the photosensitive drum 1 by the above-described pressurizing means, whereby the spacer rollers 20B always abut against the photosensitive drum 1 and the SD gap is guaranteed.

As described above, the developing container 32 is energized toward the photosensitive drum 1 by pressurizing springs 51, whereby the first developing sleeve 31A is energized toward the photosensitive drum 1. In addition, the second developing sleeve 31B is energized toward the photosensitive drum 1 by the pressurizing springs 51, the pressurizing spring 50, the pressurizing spring holder 52 and the pressurizing spring holder groove portion 26.

In this way, in this embodiment, since the second developing sleeve 31B is energized toward the photosensitive drum 1 independently of the first developing sleeve 31A, floating of the spacer rollers 20A and 20B in four parts can be prevented. Consequently, the SD gaps can be surely guaranteed for both the first and second developing sleeves 31A and 31B.

Next, a structure inside the developing device 3 in this embodiment will be described. As shown in FIG. 6, gears 23A and 23B for giving a driving force of rotation to each of the developing sleeves 31A and 31B are provided on one sides of the first developing sleeve 31A and the second developing sleeve 31B that are caused to oppose each other in the vicinity of the photosensitive drum 1. A driving force is transmitted to the gears 23A and 23B from driving force transmitting gears (not shown), whereby each of the developing sleeves 31A and 31B rotates in the direction indicated by the arrow A in FIG. 2.

As shown in FIG. 2, a developer can be contained inside the developing container 32. The agitating members 37 and 38 for agitating and feeding the developer to the first and second developing sleeves 31A and 31B side are provided inside the developing container 32.

A developer regulating blade (doctor blade) 35 (hereinafter referred to simply as the lade functioning as developer regulating means held by the developing container 32 is provided above the first developing sleeve 31A. Consequently, an amount of a developer to be borne on the surface of the first developing sleeve 31A is regulated as conventionally practiced in general.

Since the bearing 21A functioning as a supporting member of the first developing sleeve 31A and the blade 35 are provided in the developing container 32, the positional relationship in the peripheral direction of the blade 35 and the first developing sleeve 31A never changes.

In addition, a gap between the blade 35 and the first developing sleeve 31A (hereinafter referred to as "SB gap") is approximately within the range of 0.23±0.04 mm in general. If a variation width of the SB gap exceeds this level, image defects are likely to occur.

On the other hand, in the developing device 3 of this embodiment, a special developer regulating means such as the above-described blade 35 is not provided for the second developing sleeve 31B. That is, when it is assumed that a blade similar to the above-described blade 35 is provided for the second developing sleeve 31B, the SB gap varies as the second developing sleeve 31B rocks with respect to this blade. Moreover, positions in the peripheral direction of the blade and the second developing sleeve 31B deviate from each other. Due to such deviation of the positions in the peripheral direction, positions of magnetic poles in the magnetic field generating means in the second developing sleeve 31B deviate. As a result of the variation of the SB gap and the positional deviation of the magnetic poles of the magnetic field generating means in the second developing sleeve 31B, an amount of a developer borne on the surface of the second developing sleeve 31B becomes nonuniform and image defects are likely to occur.

In this embodiment, the amount of the developer borne on the second developing sleeve 31B is regulated by the gap between the first developing sleeve 31A and the second developing sleeve 31B (SS gap) and influence of a magnetic force by magnets in the first and second developing sleeves 31A and 31B.

Next, the SD gaps and the SS gap of the first and second developing sleeves 31A and 31B will be described.

The developing device 3 is arranged such that the photosensitive drum 1 and the first and second developing sleeves 31A and 31B oppose adjacent to each other and substantially in parallel with each other (FIGS. 2 and 6). In this embodiment, the SS gap, which is the gap between the first developing sleeve 31A and the second developing sleeve 31B, is guaranteed by a machining accuracy of the regulating guide groove portion 25 (FIG. 4) that is integrally formed in the developing container 32.

If the developing container 32 is manufactured by the injection molding well-known to one skilled in the art using, for example, a polystyrene-based resin material, an ABS-based resin material or a PPE+PS– based resin material, the regulating guide groove portion 25 that is integrally provided in its side wall 32*a* can be manufactured in the accuracy of ±0.1 mm or less in general. Even if a latitude (tolerance) of the SS gap discussed below is taken into account, it is possible to guarantee the SS gap by the machining accuracy of the regulating guide groove portion 25.

According to studies to date by the inventor of the present invention, it has been found that the SS gap has a wider latitude compared with the SD gaps and the SB gap and it may set the SS gap among a plurality of developing sleeves in the range of 0.40 to 0.80 mm.

Given that the SD gaps, SDa and SDb, for each of the developing sleeves 31A and 31B are 0.20 mm and the SS gap between both the developing sleeves 31A and 31B is 0.60 mm, the machining accuracy of the regulating guide groove portion 25 formed in the developing container 32 is ±0.1 mm or less as described above. Therefore, even if this is taken into account, the SS gap is still within the above-described latitude of the SS gap and image defects or the like do not occur.

In general, if spacer rollers are manufactured by cutting or the like using a POM-based resin, ultrahigh molecular weight polyethylene resin or the like, which is usually used as a material, after the injection molding well-known to one skilled in the art, a dimensional accuracy of an external diameter of the spacer rollers is 0.015 mm or less.

In addition, in the foregoing assumption, a gap between the spacer rollers 20A and 20B for each of the first and second developing sleeves 31A and 31B is 0.20 mm. Since the dimensional accuracy of the external diameter of the spacer rollers is 0.015 mm or less, the spacer rollers 20A and 20B do not interfere with each other. Therefore, as shown in FIG. 6, the spacer rollers 20A and 20B can be arranged in the same position with respect to longitudinal directions of the first and second developing sleeves 31A and 31B, respectively. Consequently, a space occupied by the device can be reduced. It is needless to mention that the present invention is not limited to this and the spacer rollers 20A and 20B can be arranged in different positions in the longitudinal directions of each of the developing sleeves 31A and 31B.

Further, the above-described values of the SD gaps and the SS gap are simply examples and the present invention is not limited to these values. It is needless to mention that, in implementing the present invention, it is desirable to realize and decide optimization of the SDa and SDb gaps and the SS gap according to a specification and a structure of the device.

As described above, according to the structure of this embodiment, development is performed for a plurality of times by the first and second developing sleeves 31A and 31B, whereby a developing area can be provided larger than the conventional developing system using one developing sleeve and it is possible to increase the process speed of image formation (copy speed). In addition, since the first and second developing sleeves 31A and 31B can be provided adjacent to each other and integrally formed in the developing device 3, it is possible to miniaturize the device.

In addition, the adjacent developing sleeves 31A and 31B are energized to the photosensitive drum 1 independently, whereby floating of the spacer rollers 20A and 20B provided at both the ends of each of the developing sleeves 31A and 31B can be prevented. Consequently, the gaps between the plurality of developing sleeves 31A and 31B and the photosensitive drum 1 (SD gaps) can be surely guaranteed to perform stable multi-stage development.

Moreover, at least one of the adjacent developing sleeves 31A and 31B (the second developing sleeve 31B in this embodiment) is regulated by the regulating guide groove portion 25 integrally provided in the sidewall portion of the developing container 32, whereby the SS gap can be guaranteed. In addition, by such a regulating guide groove 25, one of the adjacent developing sleeves 31A and 31B (the second developing sleeve 31B in this embodiment) is supported movably and rotatably in a microscopic area with the first developing sleeve 31A as a rotational center, whereby the SD gap can be guaranteed.

Further, although the coil springs, which are elastic members, are used as the pressurizing member for energizing the developing container 32 toward the photosensitive drum 1 and the pressurizing member for energizing the second developing sleeve 31B toward the photosensitive drum 1 in this embodiment, the present invention is not limited to this. The pressurizing members may be appropriately selected from elastic members such as a leaf spring and a helical torsion coil spring.

In addition, although the bearings (ball bearings) are used as the supporting members for supporting the first and second developing sleeves 31A and 31B in this embodiment, the present invention is not limited to this. The supporting members may be sliding bearings manufactured with a material including resin or sintered metal.

Second Embodiment

Figure 7:
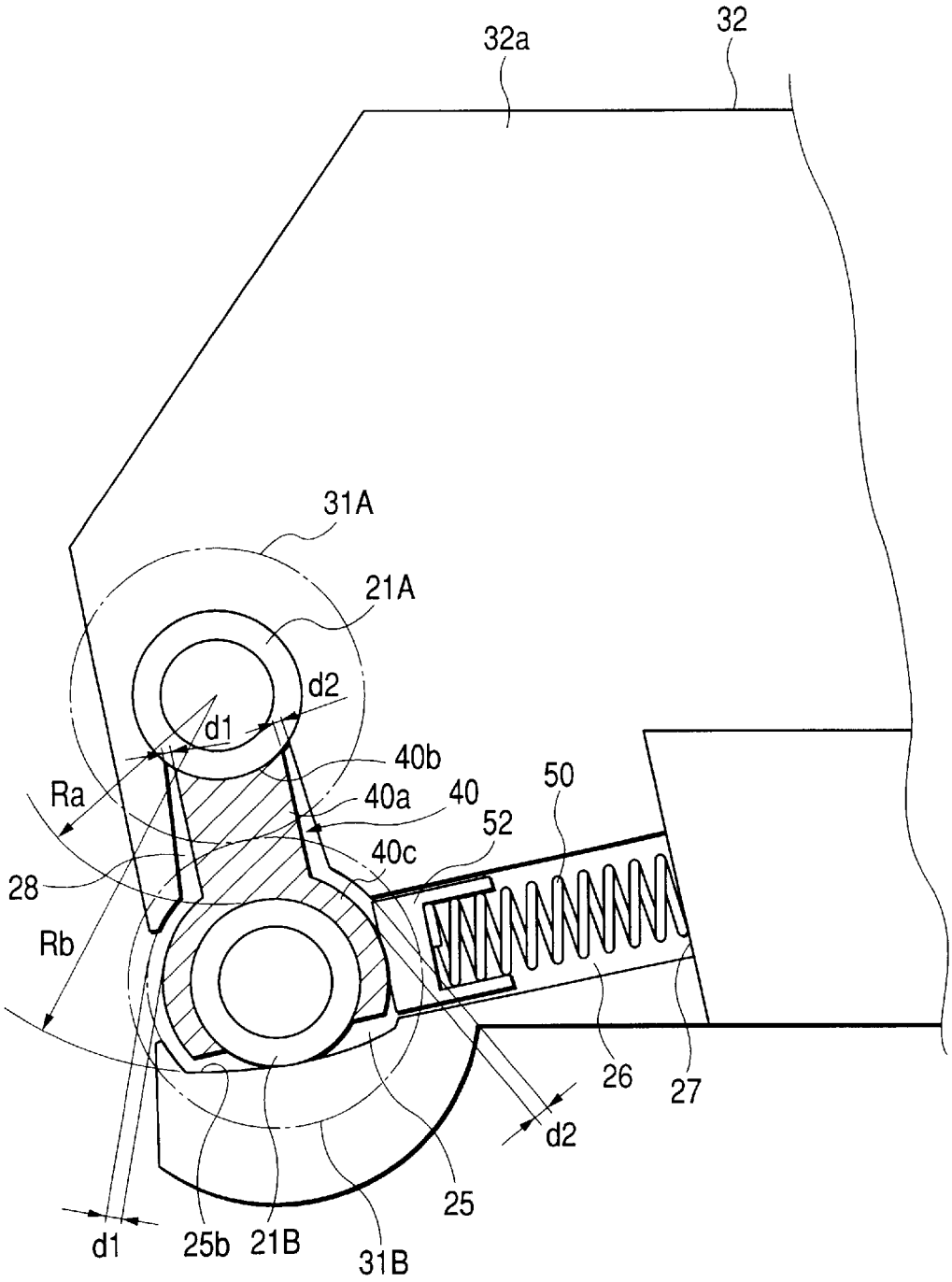
FIG. 7 is a partly enlarged side view of a developing container showing another embodiment of a supporting portion (positioning portion) of a developer bearing member in accordance with the present invention.

Next, another embodiment of the present invention will be described. FIG. 7 shows a structure of a regulating guide groove portion and pressurizing means in this embodiment in a partially enlarged form. The basic structure and operations of the developing device and the image forming apparatus are the same as those in the first embodiment. Therefore, elements having the same functions as those in the first embodiment are denoted by the identical reference symbols and detailed descriptions on them are omitted.

As shown in FIG. 7, in this embodiment, a spacer swinging member 40, which is a separate member, performs the same function as the wall portion 25*a* along the arc of the radius Ra with the rotational center of the first developing sleeve 31A as a center in the regulating guide groove portion 25 described with reference to FIG. 3.

In this embodiment, the wall portion 25*a* of the regulating guide groove portion 25 in the first embodiment is notched and a spacer groove portion 28 extending to the attaching hole portion 22 of the developing container 32, to which the bearing 21A of the first developing sleeve 31A is attached, is provided. In addition, a spacer swinging member 40 is arranged between the bearing 21A of the first developing sleeve 31A and the bearing 21B of the second developing sleeve 31B through the spacer groove portion 28.

The spacer swinging member 40 indicated by a cross-hatching portion in FIG. 7 is provided with a spacer portion 40*a* for guaranteeing the SS gap between the first developing sleeve 31A and the second developing sleeve 31B. In this embodiment, the spacer portion 40*a* of the spacer swinging member 40 plays a role of maintaining a space between the bearing 21A of the first developing sleeve 31A and the bearing 21B of the second developing sleeve 31B. In addition, the spacer swinging member 40 abuts against each of the bearings 21A and 21B at bumping portion 40*b* and 40*c*. Further, the wall portion 25*b* along the arc of the radius Rb with the rotational center of the first developing sleeve 31A as a center regulates the bearing 21B of the second developing sleeve 31B as in the first embodiment. Consequently, a predetermined gap between the first developing sleeve 31A and the second developing sleeve 31B is maintained.

In this embodiment, the bumping portions 40*b* and 40*c* of the spacer swinging member 40 abut against each of the bearings 21A and 21B with a predetermined peripheral length along the outer circumference of each of the bearings 21A and 21B. In addition, the bumping portion 40*c* abutting on the bearing 21B of the second developing sleeve 31B extends along most of the outer circumference of the bearing 21B excluding the vicinity of an area where the bearing 21B abuts against the wall portion 25*b* of the regulating guide groove portion 25.

Here, the regulating guide groove portion 25 is provided with microscopic gaps d1 and d2 between the bumping members 40*b* and 40*c* on a front end side and a rear end side in the rotational direction with the first developing sleeve 31A as a center, respectively, in the state where the bearing 21B of the second developing sleeve 31B and the spacer swinging member 40 fitted therein. As described in the first embodiment, these gaps are for allowing a plurality of developing sleeves to approach the photosensitive drum 1 smoothly, and it may select a size of the gaps appropriately.

Consequently, the second developing sleeve 31B is allowed to move within a microscopic area by the extent of the above-described gaps, only in the rotational direction with the first developing sleeve 31A as a center while being regulated by the spacer swinging member 40 and the wall portion 25*b* of the regulating guide groove portion 25.

In this embodiment, it is assumed that the pressurizing means for pressurizing the second developing sleeve 31B toward the photosensitive drum 1 is substantially the same as that in the first embodiment. In this embodiment, since the outer circumference of the bearing 21B is surrounded by the spacer swinging member as described above, the pressurizing spring 50 pressurizes the spacer swinging member 40 via the pressurizing spring holder 52.

The spacer swinging member 40 is preferably formed of a material that has slidability and anti-toner property, that is, high resistance against deterioration due to contact with toner (developer), for example, the POM-based resin.

As described above, the same effects as described in the first embodiment can be obtained by the structure of this embodiment. In addition, the following effects can also be obtained. That is, since the spacer swinging member 40 is a small component compared with the developing container 32, it is easy to improve a manufacturing accuracy. There is an effect that this results in reduction of inspection processes, reduction of parts management expenses and reduction of manufacturing expenses of molds by restraining unevenness of dimensions during production and can contribute to reduction of costs. In addition, since the spacer swinging member 40 can be formed of a material different from the developing container 32, loss of a pressurizing force for pressurizing the second developing sleeve 31B toward the photosensitive drum 1 due to rubbing can be mitigated by, for example, improving the slidability of the first developing sleeve 31A and the bearing 21A.

Further, even if the spacer swinging member 40 is manufactured integrally with the bearing 21B of the second developing sleeve 31B as an example of modification, the effect of this embodiment remains the same.

In addition, although the bumping portion 40*c* abutting on the bearing 21B, which is the supporting member of the second developing sleeve 31B of the spacer swinging member 40, is structured to surround substantially all the area of the outer circumference of the bearing 21B in this embodiment, the present invention is not limited to this. The bumping portion 40*c* may be structured to abut against the bearing 21B along a shorter outer circumference area. In this case, as in the first embodiment, the bearing 21B of the second developing sleeve 31B may be pressurized by the pressurizing spring 50 via, for example, the pressurizing spring holder 52.

Third Embodiment

Figure 8:
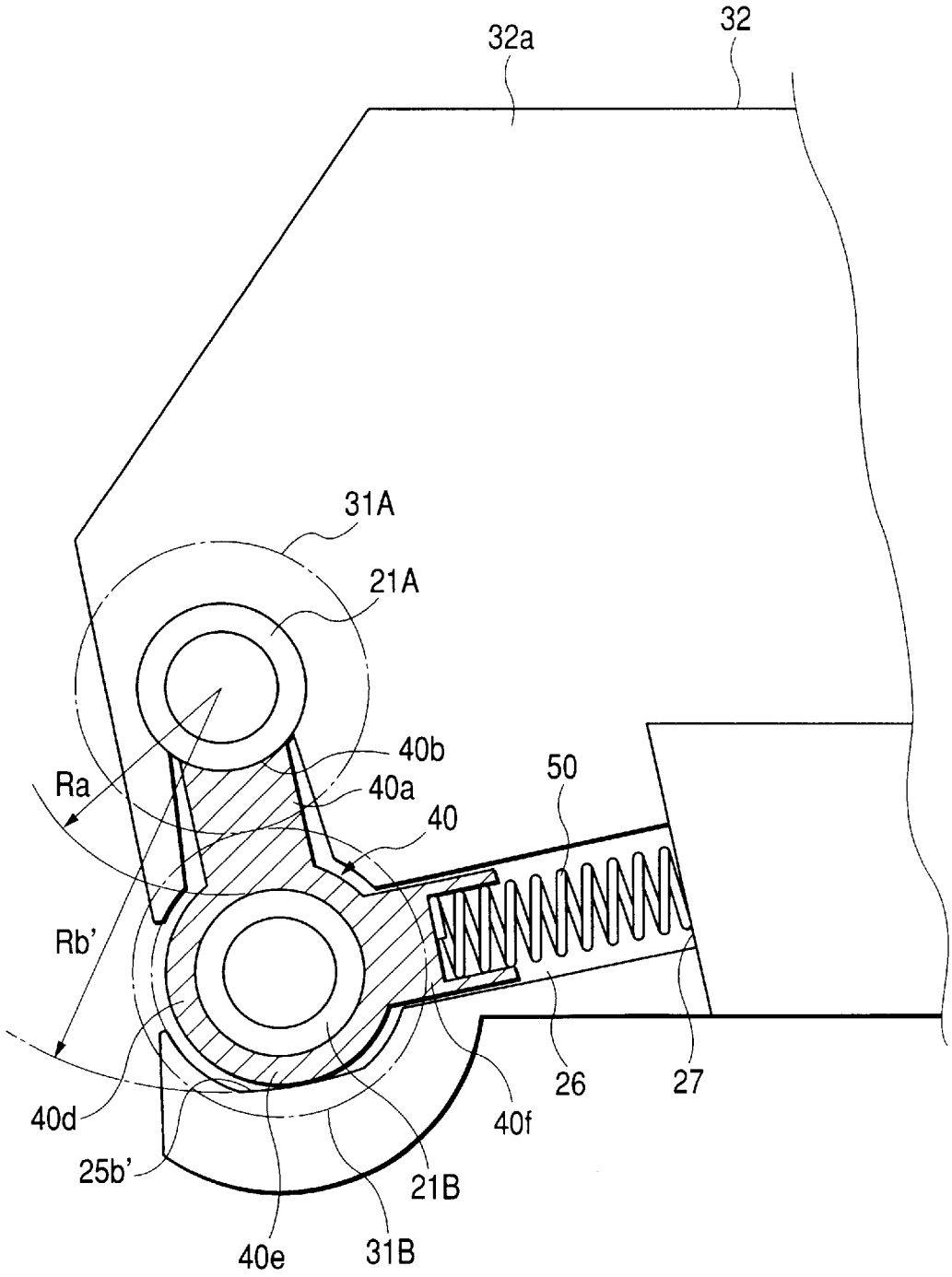
FIG. 8 is a partly enlarged side view of a developing container showing another embodiment of the supporting portion (positioning portion) of the developer bearing member in accordance with the present invention.

Next, another embodiment of the present invention will be described. FIG. 8 shows a structure of a regulating guide groove portion and pressurizing means in this embodiment in a partially enlarged form.

In this embodiment, the spacer swinging member 40 having the same function as the spacer swinging member 40 of the second embodiment has a sliding portion 40*e* that abuts against a wall portion 25*b*' of the regulating guide groove portion 25 along an arc of a radius Rb' with the rotational center of the first developing sleeve 31A as a center in addition to the structure of the second embodiment.

That is, the spacer swinging member 40 indicated by a crosshatching portion in FIG. 8 is provided with a spacer portion 30*a* for guaranteeing the SS gap between the first developing sleeve 31A and the second developing sleeve 31B and the bumping portion 40*b* abutting on the bearing 21A of the first developing sleeve 31A. In addition, in this embodiment, the second developing sleeve 31B side of the spacer swinging member 40 includes the above-described sliding portion 40*e* and forms a holding portion 40*d* surrounding the entire outer circumference of the bearing 21B.

As in the first embodiment, the spacer portion 40*a* of the spacer swinging member 40 plays a role for maintaining the space between the bearing 21A and the bearing 21B. In addition, in this embodiment, the sliding portion 40*e* of the spacer swinging member 40 is regulated by the wall portion 25*b*' of the regulating guide groove portion 25 along the arc of the above-mentioned radius Rb'.

Consequently, the second developing sleeve 31B is allowed to move within a microscopic area only in the rotational direction with the first developing sleeve 31A as a center while being regulated by the spacer swinging member 40 and the wall portion 25*b* of the regulating guide groove portion 25.

Moreover, in this embodiment, the spacer swinging member 40 has a shape in which the pressurizing spring holder portion 40*f* having the function of the pressurizing spring holder 52 in the first and second embodiments is integrally formed.

The pressurizing means for pressurizing the second developing sleeve 31B toward the photosensitive drum 1 is the same as the pressurizing means in the each above-described embodiment except that the pressurizing spring holder portion 40*f* is integrally provided in the spacer swinging member 40. That is, in this embodiment, the spacer swinging member 40 is pressurized by the pressurizing spring 50 via the pressurizing spring holder portion 40*f* integrally formed in the spacer swinging member 40.

As in the second embodiment, the spacer swinging member 40 of this embodiment preferably has the sliding portion 40*e* and the pressurizing spring holder portion 40*f* integrally formed therein by a POM-based resin that is a material excellent in slidability and the anti-toner property.

As described above, according to the structure of this embodiment, the effects described in the first and second embodiments can be obtained and, moreover, there is an effect that it can contribute to further reduction of costs by forming the pressurizing spring holder portion 40*f* integrally with the spacer swinging member 40.

Further, even if the spacer swinging member 40 is manufactured integrally with the bearing 21B of the second developing sleeve 31B as an example of modification, the effect of this embodiment remains the same.

Fourth Embodiment

Figure 9:
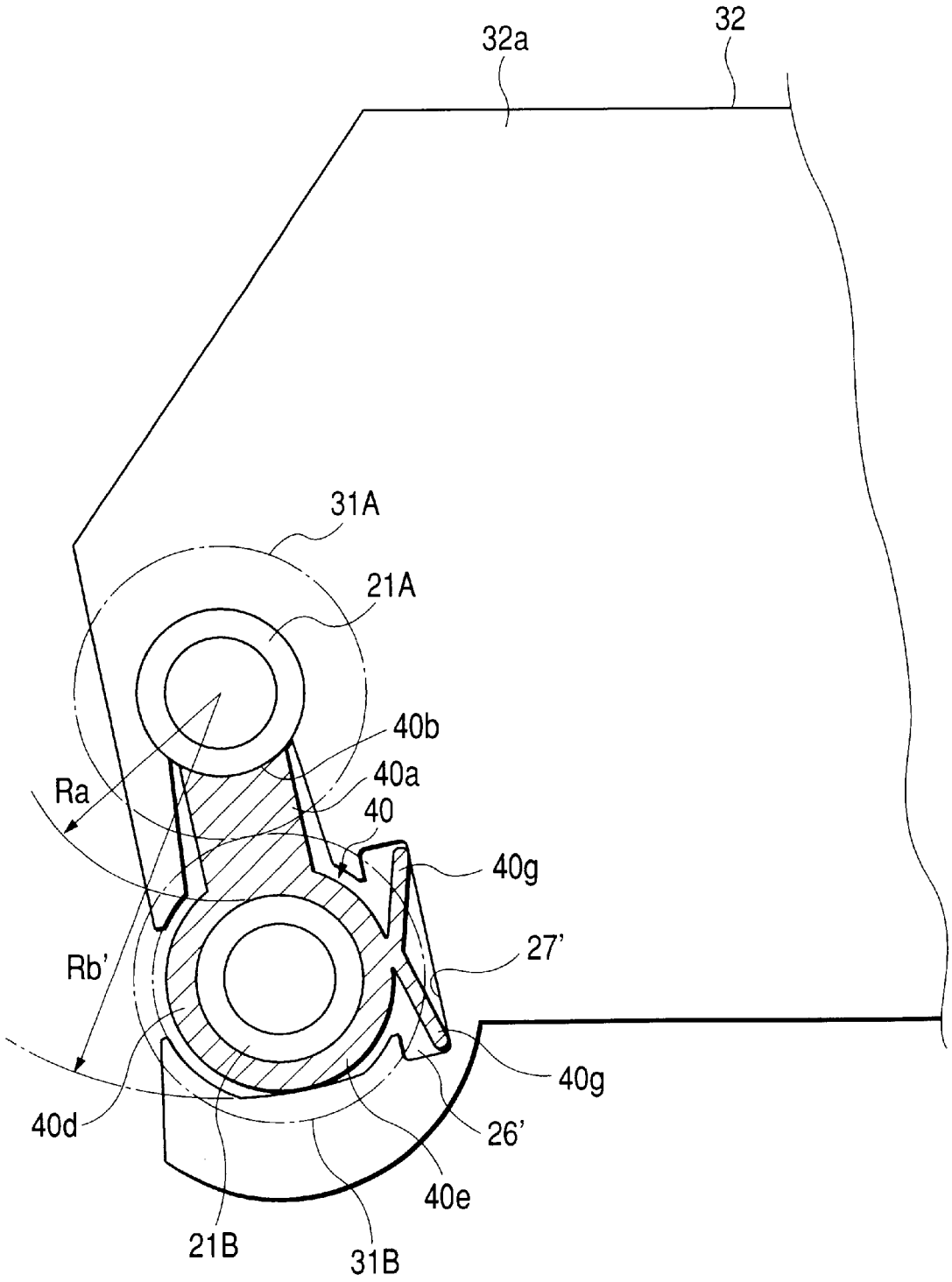
FIG. 9 is a partly enlarged side view of a developing container showing another embodiment of the supporting portion (positioning portion) of the developer bearing member in accordance with the present invention.

Next, another embodiment of the present invention will be described. FIG. 9 shows a structure of a regulating guide groove portion and pressurizing means in this embodiment in a partially enlarged form.

In this embodiment, the spacer swinging member 40 having the same function as the spacer swinging member 40 of the third embodiment is further provided with the function of the pressurizing spring 50 in the first, second and third embodiments in addition to the structure of the third embodiment.

That is, the spacer swinging member 40 indicated by a crosshatching portion in FIG. 9 has a leaf spring shape 40*g* integrally formed with the holding portion 40*d* surrounding the outer circumference of the bearing 21B of the second developing sleeve 31B by the same resin material as the spacer swinging member 40.

In addition, in this embodiment, the developing container 32 is provided with a leaf spring groove portion 26' for containing the leaf spring shape portion 40*g* and a leaf spring bumping portion 27' functioning as a pressurizing member receiving portion, on which the leaf spring shape portion 40*g* bumps, that have substantially the same functions as the pressurizing spring holder groove portion 26 and the pressurizing spring bumping portion 27, respectively, in the first, second and third embodiments.

As in the second and third embodiments, the spacer swinging member 40 of this embodiment preferably has the leaf spring shape portion 40*g* integrally formed therein by a POM-based resin that is a material excellent in slidability and the anti-toner property.

As described above, according to the structure of this embodiment, the effects described in the above-mentioned embodiments can be obtained. Moreover, there is an effect that it can contribute to further reduction of costs by making a resin material that forms a spacer swinging member 40 leaf spring-shaped and thus making the function of the pressurizing spring integral with the spacer swinging member 40.

Further, even if the spacer swinging member 40 is manufactured integrally with the bearing 21B of the second developing sleeve 31B as an example of modification, the effect of this embodiment remains the same.

Fifth Embodiment

Figure 10:
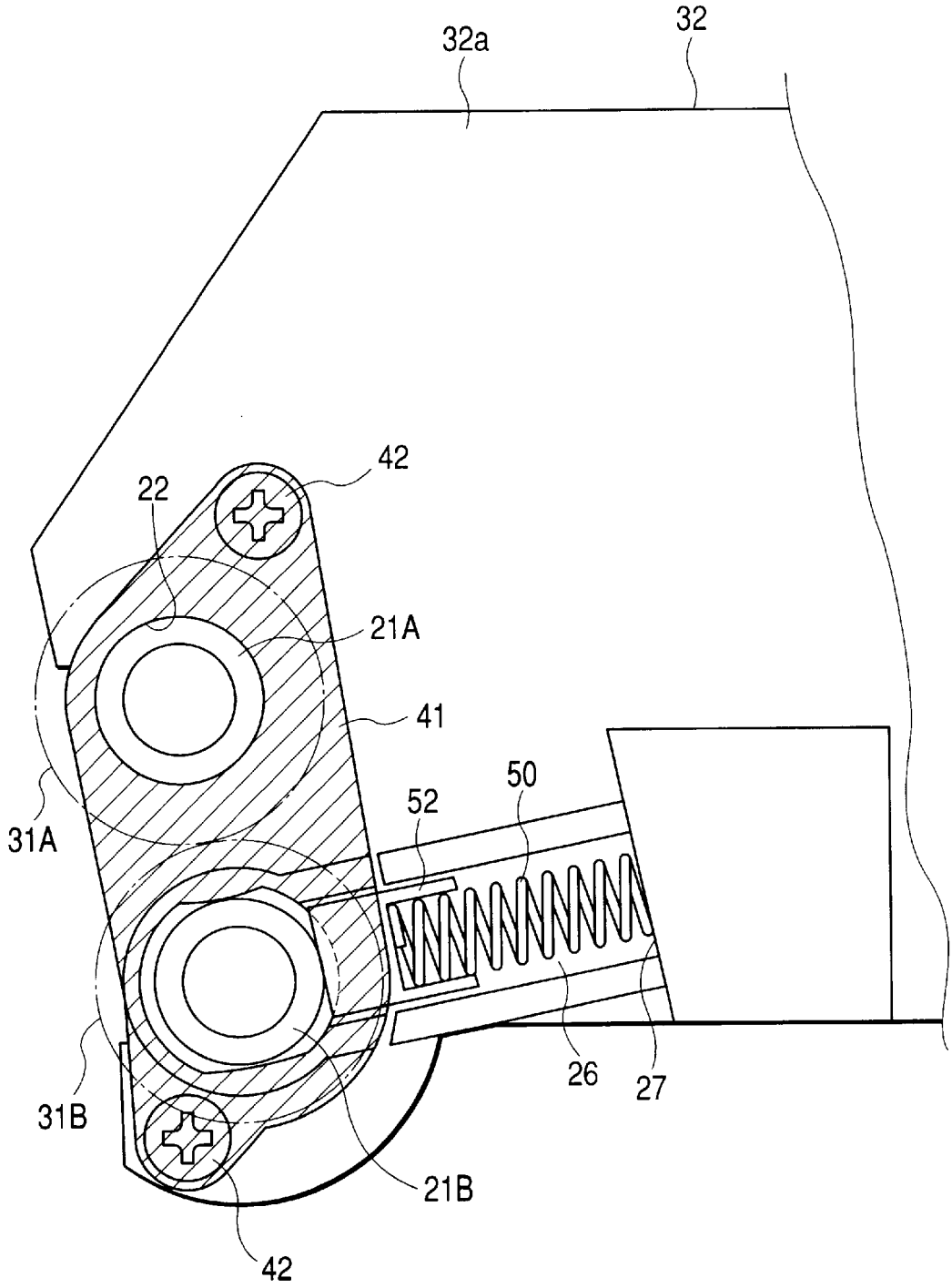
FIG. 10 is a partly enlarged side view of a developing container showing yet another embodiment of the supporting portion (positioning portion) of the developer bearing member in accordance with the present invention.

Next, another embodiment of the present invention will be described. FIG. 10 shows a structure of a regulating guide groove portion and pressurizing means in this embodiment in a partially enlarged form.

In this embodiment, a method of positioning the first and second developing sleeves 31A and 31B is the same as that in the first embodiment that does not use the spacer swinging member 40. However, in this embodiment, the attaching hole portion 22 for attaching the bearing 21A of the first developing sleeve 31A and the regulating guide groove portion 25 in which the bearing 21B of the second developing sleeve 31B is fitted, which are formed in the developing container 32 in the first embodiment, are formed as a positioning member 41 that is a separate member from the developing container 32 in advance. The positioning member 41 is attached to the developing container 32 later to form supporting means of the first and second developing sleeves 31A and 31B.

The positioning member 41 indicated by a crosshatching portion in FIG. 10 is attached to the developing container 32 in two parts by screws 42, 42. Further, a method of attaching the positioning member 41 to the developing container 32 is not limited to screwing, and it may appropriately select and use a general attaching method such as adhesion.

The positioning member 41 is preferably formed with a material excellent in slidability and the anti-toner property, for example, a POM-based resin.

As described above, according to the structure of this embodiment, the same effects as described in the first embodiment can be obtained by the structure of this embodiment. In addition, the following effects can also be obtained.

That is, since the positioning member 41 is a small component compared with the developing container 32, it is easy to improve a manufacturing accuracy in the same manner as the spacer swinging member 40 in the second to fourth embodiments. There is an effect that this results in reduction of inspection processes, reduction of parts management expenses and reduction of manufacturing expenses of molds by restraining unevenness of dimensions during production and can contribute to reduction of costs. In addition, since the positioning member 41 can be formed of a material different from the developing container 32, loss of a pressurizing force for pressurizing the second developing sleeve 31B toward the photosensitive drum 1 due to rubbing can be mitigated by, for example, improving its slidability.

Further, the pressurizing spring groove portion 26 and the pressurizing spring bumping portion 27 may be further formed integrally with the positioning member 41. In this case, the same effects as described above can be obtained.

In addition, although the attaching hole portion 22 for attaching the bearing 21A functioning as the supporting member of the first developing sleeve 31A and the regulating guide groove portion 25 in which the bearing 21B functioning as the supporting member of the second developing sleeve 31B is fit are provided in the positioning member 41 as shown in FIG. 10 in this embodiment, the present invention is not limited to this. The attaching hole 22 of the bearing 21A may be provided in the developing container 32 and at least the regulating guide groove portion 25 may be formed as the positioning member 41 separately from the developing container 32. In this case, the same effects as described above can be obtained.

Here, the above-described second to fifth embodiments can be combined. That is, as it will be understood with reference to FIGS. 7 to 10, for example, the pressurizing spring holder portion 40*f* shown in FIG. 8 or the leaf spring shape portion 40*g* shown in FIG. 9 may be integrally provided in the bumping portion 40*c* abutting on the bearing 21B of the spacer swinging member 40 in FIG. 7. Moreover, the above-mentioned spacer swinging member 40 and the positioning member 41 may be provided with a portion for preventing coming off in a thrust direction of the bearings 21A and 21B (axial direction of the developing sleeve). One skilled in the art can easily anticipate a modified form, in which the above-described embodiments are combined, from each of them according to a specification and a structure of the device.

Sixth Embodiment

Figure 11:
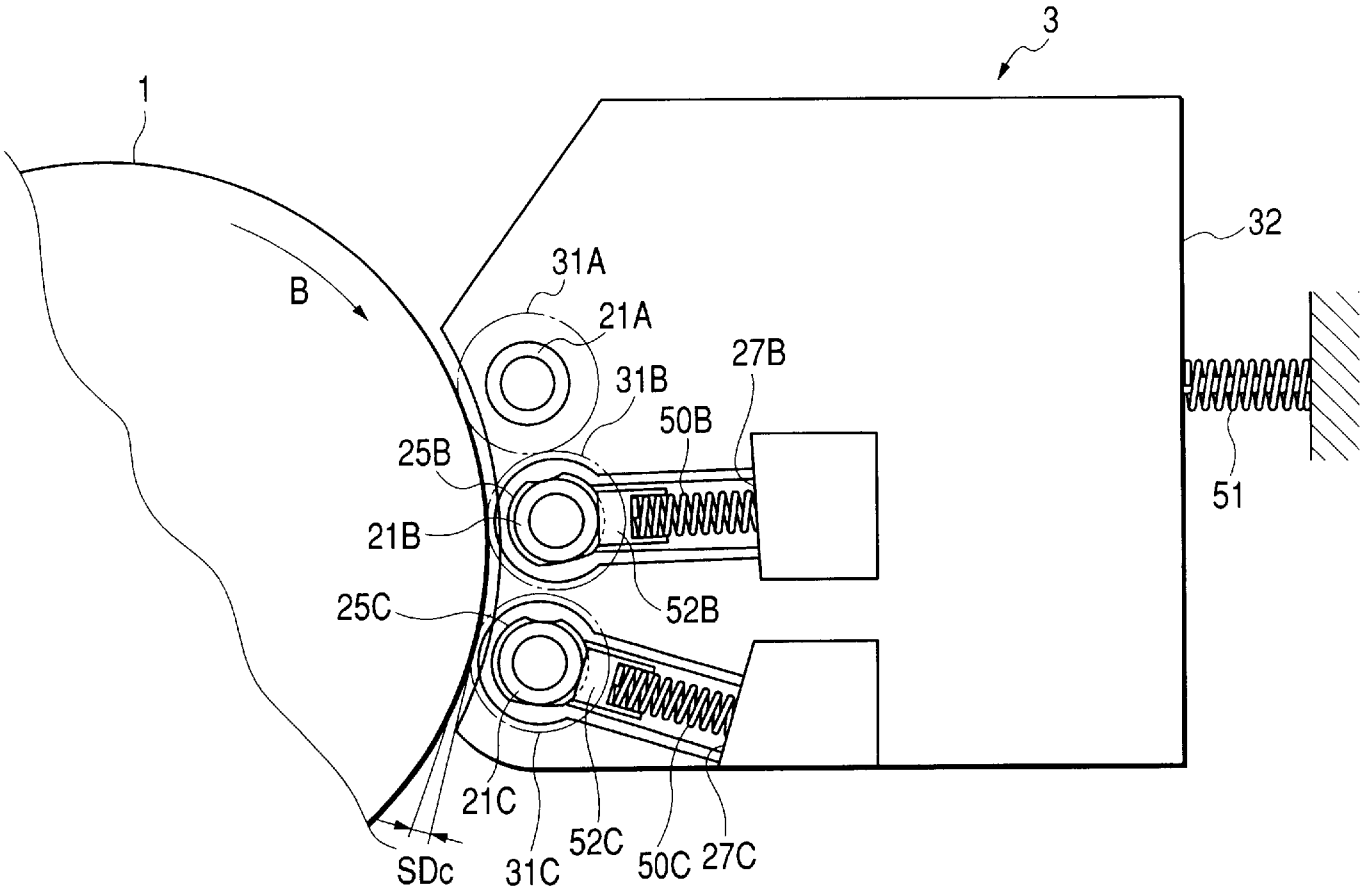
FIG. 11 is a schematic side view of another embodiment of the developing device in accordance with the present invention.

Next, yet another embodiment of the present invention will be described. In this embodiment, the present invention is applied to a multi-stage developing device provided with three developing sleeves 31A, 31B and 31C. FIG. 11 shows a side of the developing device of this embodiment. Further, the developing device and the image forming apparatus of this embodiment are the same as those in the above-described each embodiment in their basic structure and operations except that they have third developing sleeve 31C functioning as a third developer bearing member and further have a structure for positioning the third developing sleeve 31C. Therefore, here, elements having the same functions and structures are denoted by the identical reference symbols and descriptions on them are omitted.

As shown in FIG. 11, in this embodiment, the same principle as the first embodiment is applied to a positioning method of the third developing sleeve 31C.

That is, in this embodiment, as in the case in which two developing sleeves are used, the same regulating guide groove portion 25C as in the first embodiment is provided for the third developing sleeve 31C in order to always cause the third developing sleeve 31C to approach (bump) the photosensitive drum 1 steadily.

It may define a shape of the regulating guide groove portion 25C on the basis of the second developing sleeve 31B. That is, a wall portion along an arc of a predetermined radius with the rotational center of the second developing sleeve 31B as a center is provided at least in one part in the regulating guide groove portion 25C for the third developing sleeve 31C. Consequently, the SS gap between the second and third developing sleeves 31B and 31C is guaranteed and the third developing sleeve 31C is allowed to move within a microscopic area only in the rotational direction with the second developing sleeve 31B as a center.

As described above, the SS gap has a wider latitude compared with the SB gap. Therefore, even if the second developing sleeve 31B moves in a microscopic area and the SS gap between the second developing sleeve 31B and the third developing sleeve 31C varies, this does not have so large influence as to cause image defects.

In addition, SDc that is a SD gap between the third developing sleeve 31C and the photosensitive drum 1 is guaranteed by spacer rollers (not shown) as in the first and second developing sleeves 31A and 31B.

Further, although the structure described in the first embodiment is employed as the structure for positioning the second and third developing sleeves 31B and 31C in this embodiment, it is needless to mention that it is possible to employ any one of the structures described in the second to fifth embodiments or any combination thereof.

As it can be seen from this embodiment, the present invention is not limited to the case in which two developing sleeves are used and can be further applied to a multi-stage developing device using a plurality of developing sleeves. In this case, the same effects as described in the above-described each embodiment can be obtained.

As described above, according to the above-described each embodiment, a developing area can be provided widely and a process speed of image formation can be increased by performing development for a plurality of times using a plurality of developer bearing members. In addition, a developing device can be miniaturized and high image quality can be realized by providing the plurality of developer bearing members in vicinity to each other to be formed integrally with the developing device.

Moreover, with the developing device integrally provided with the plurality of developer bearing members, floating of a spaced member between each of the plurality of developer bearing members and an image bearing member can be prevented, the plurality of developer bearing members can be surely caused to approach the image bearing member and stable image formation can be performed. In addition, a gap between the image bearing member and the developer bearing members can be guaranteed and, at the same time, a gap among the plurality of developer bearing members can be guaranteed.

Thus, it is seen that a developing device is provided. One skilled in the art will appreciate that the present invention can be practiced by other than the preferred embodiment which is presented for the purposes of illustration and not of limitation, and the present invention can be modified in any way within the technical thoughts of the present invention.

What is claimed is:

1. A developing device comprising:

a developing container for containing a developer, said developing container being provided at a position so as to be opposite to an image bearing member;

first and second developer bearing members for bearing and carrying the developer in said developing container to said image bearing member, wherein said developing container comprises a first supporting portion for supporting a rotational shaft of said first developer bearing member and a second supporting portion for supporting a rotational shaft of said second developer bearing member so that said second developer bearing member is swingable about said first supporting portion as a swinging center; and a pressurizing member for pressurizing a portion in the vicinity of an end of said second developer bearing member toward a side of said image bearing member, wherein a portion of said second supporting portion for guiding a swing of said second developer bearing member is shaped in the form of an arc so that a distance between said first developer bearing member and said second developer bearing member does not substantially vary.

2. A developing device according to claim 1, wherein said first supporting portion is a first hole portion for rotatably supporting a rotational shaft of said first developer bearing member, wherein said second supporting portion is a second hole portion for rotatably and swingably supporting a rotational shaft of said second developer bearing member, and wherein said second hole portion is provided with an arc-shaped portion so that a distance between said first hole portion and said second hole portion does not substantially vary.

3. A developing device according to claim 1, further comprising a developing container pressurizing member for pressurizing said developing container toward the side of said image bearing member.

4. A developing device according to claim 3, further comprising:

a first regulating member for regulating a distance between said first developer bearing member and said image bearing member; and a second regulating member for regulating a distance between said second developer bearing member and said image bearing member, wherein said first regulating member is brought into pressure contact with said image bearing member by said developing container pressurizing member and said second regulating member is brought into pressure contact with said image bearing member by said developing container pressurizing member and said pressurizing member.

5. A developing device according to claim 1, wherein said first developer bearing member regulates a thickness of a layer of the developer on said second developer bearing member.

6. A developing device according to claim 1, wherein said first supporting portion and said second supporting portion, respectively, have holes for supporting through bearings the rotational shafts of said first developer bearing member and said second developer bearing member.

7. A developing device according to any one of claims 1, 3, 4, 5, or 6, wherein the developer is supplied by said first developer bearing member and then is supplied by said second developer bearing member to a common electrostatic latent image formed on said image bearing member.

* * * * *

UNITED STATES PATENT AND TRADEMARK OFFICE

CERTIFICATE OF CORRECTION

PATENT NO. : 6,735,410 B2
DATED : May 11, 2004
INVENTOR(S) : Hajime Sekiguchi

It is certified that error appears in the above-identified patent and that said Letters Patent is hereby corrected as shown below:

Title page,
Item [30], References Cited, "2001/163154" should read -- 2001-163154 --.

Column 10,
Line 61, "sides" should read -- side --.

Column 18,
Line 37, "As described above," should be deleted; and "according" should read -- according --;
Line 59, "embodiment" should read -- embodiments --; and
Line 60, "is" should read -- are --.

Signed and Sealed this

Seventh Day of September, 2004

JON W. DUDAS
*Director of the United States Patent and Trademark Office*